US005649704A

United States Patent [19]

Dobbin

[11] Patent Number: 5,649,704

[45] Date of Patent: Jul. 22, 1997

[54] DICE GAME METHOD

[76] Inventor: Terry L. Dobbin, 8278 Rosemont, Detroit, Mich. 48228

[21] Appl. No.: 670,088

[22] Filed: Jun. 25, 1996

[51] Int. Cl.[6] ..... A63F 9/04

[52] U.S. Cl. ..... 273/268; 273/146

[58] Field of Search ..... 273/268, 146, 273/145 R, 148 R

[56] References Cited

U.S. PATENT DOCUMENTS

| | | | |
|---|---|---|---|
| 3,614,105 | 10/1971 | Dandini | 273/146 |
| 4,834,386 | 5/1989 | Rosenthal et al. | 273/146 |
| 4,893,816 | 1/1990 | Levy et al. | 273/146 |
| 4,930,780 | 6/1990 | Goodman et al. | 273/146 |
| 4,936,588 | 6/1990 | Rader et al. | 273/268 |
| 5,013,040 | 5/1991 | Schiehl | 273/146 |
| 5,050,888 | 9/1991 | Schultz et al. | 273/146 |
| 5,176,381 | 1/1993 | Winters | 273/146 |
| 5,388,830 | 2/1995 | Dixson | 273/146 |
| 5,405,145 | 4/1995 | Jones et al. | 273/146 |
| 5,456,467 | 10/1995 | Hoover | 273/146 |

*Primary Examiner*—William M. Pierce
*Attorney, Agent, or Firm*—Joseph N. Breaux

[57] ABSTRACT

A method of playing a dice game is provided of the type wherein points are accumulated based upon the scores received for various combinations of numerical values displayed from a roll or throw of a plurality of dice, and by increasing a thrown score and deducting from or adding to the accumulated score this increased score based upon a roll of a die. The dice game comprises the steps of: providing six playing dice; providing a bonus die having six faces, three faces having "DOUBLE" marked thereon and three faces having "TRIPLE" marked thereon; establishing an initial order of play; initiating play by throwing the playing dice for displaying a side of each die, wherein each player in turn throws the dice in an attempt to achieve a score of 10,000 points to be declared a winner; wherein upon reaching a score of 650 points a player may choose to "dare," whereby, the player throws the bonus die and doubles or triples the thrown score as indicated by the displayed face of the bonus die, and the player throws a playing die, whereupon throwing a one or a five the player adds the increased thrown score to the accumulated score and whereupon throwing a two, three, four or six the player deducts the increased thrown score from the accumulated score.

20 Claims, 2 Drawing Sheets

DICE GAME METHOD

TECHNICAL FIELD

The present invention relates to devices and methods for playing dice games and more particularly to devices and methods for playing dice games that provides for a player to double or triple a score of thrown playing dice after a predetermined number of points have been accumulated, the multiplied score to be added to or deducted from the players accumulated points after rolling a single die.

BACKGROUND ART

Dice games generally employ one or more dice which, when thrown or rolled upon a horizontal surface, determine a score based upon indicia displayed by the upwardly facing sides or faces of the resting dice. Each die is in the form of a six sided cube, and each side commonly has thereon different quantities of spots respectively representing the numbers 1, 2, 3, 4, 5 and 6.

In many of the prior art dice games six dice are thrown and points are scored or accumulated by throwing "triplets." While these games provide a means for a number of players to compete they do not provide the added challenge of receiving points for throwing different combinations of dice. These prior art games, further, do not provide a means of increasing the point value of a throw, after surpassing a predetermined point value, at the risk of having the increased point value of the throw deducted from the player's accumulated point total.

It would be a benefit, therefore, to have a dice game allowing players to compete against one another by accumulating points based on points received from throwing various combinations of dice. It would be a further benefit to have a dice game that has a bonus die for rolling to either double or triple a thrown score after a predetermined number of points have been accumulated. It would be an additional benefit to have a dice game in which a die is thrown to determine whether the increased score of a throw is added to or deducted from the player's accumulated point total.

GENERAL SUMMARY DISCUSSION OF INVENTION

It is thus an object of the invention to provide a dice game that has six playing dice for throwing and receiving points based on various combinations of indicia displayed by the upwardly facing sides or faces of the resting dice.

It is a further object of the invention to provide a dice game that has a bonus die having "DOUBLE" marked on three sides and having "TRIPLE" marked on three sides for rolling after a predetermined number of points have been accumulated for doubling or tripling the player's thrown score, the increased score to be added to or deducted from the player's accumulated score based on a roll of a die having spots on each side indicating a numerical of 1, 2, 3, 4, 5 and 6 respectively.

It is a still further object of the invention to provide a dice game that has a position die each side thereof commonly having thereon different quantities of spots respectively representing the numbers 1, 2, 3, 4, 5 and 6, for throwing by each player at the beginning of the game for determining the order of play from the highest number thrown to the lowest.

It is a still further object of the invention to provide a dice game that has a box for storing the dice in and providing a playing space.

Accordingly, a dice game is provided of the type wherein points are accumulated based upon the scores received for various combinations of numerical values displayed from a roll or throw of a plurality of dice, and by increasing a thrown score and deducting from or adding to the accumulated score this increased score based upon a roll of a die. The dice game comprises the steps of: providing six playing dice, each die of which having six sides including a first side having thereon one spot, a second side having thereon two spots, a third side having thereon three spots, a forth side having thereon four spots, a fifth side having thereon five spots, and a sixth side having thereon six spots; providing a bonus die having six faces, three faces having "DOUBLE" marked thereon and three faces having "TRIPLE" marked thereon; establishing an initial order of play where players are designated as the first player, second player, and so on to a last player; initiating play by throwing the playing dice for displaying a side of each die, wherein each player in turn throws the dice in an attempt to achieve a score of 10,000 points to be declared a winner; wherein each die showing a one scores 100 points; wherein each die showing a five scores 50 points; wherein a throw of three of a kind resulting in three 1's accumulates 1,000 points, three 2's accumulates 200 points, three 3's accumulates 300 points, three 4's accumulates 400 points, three 5's accumulates 500 points and three 6's accumulate 600 points; wherein throws containing three pairs accumulate 850 points; wherein throws showing a straight accumulates 1500 points; wherein throws of six of a kind automatically wins the game; and whereupon reaching a score of 650 points a player may choose to "dare," whereby, the player throws the bonus die and doubles or triples the thrown score as indicated by the displayed face of the bonus die, and the player throws a die, whereupon throwing a one or a five the player adds the increased thrown score to the accumulated score and whereupon throwing a two, three, four or six the player deducts the increased thrown score from the accumulated score.

Preferably the dice game further includes a position die having six sides including a first side having thereon one spot, a second side having thereon two spots, a third side having thereon three spots, a forth side having thereon four spots, a fifth side having thereon five spots, and a sixth side having thereon six spots. More preferably, the position die is larger in size than the playing dice. The position die being use for establishing the initial order of play by each player throwing the die. The order of play being determined from the highest throw to the lowest roll. The position die may used for determining whether the increased score during a "dare" is either added to or deducted from the player's accumulated score.

The dice game may further include a game box having a bottom wall and four side walls extending upwardly about its periphery to define a playing space for throwing the dice therein. Preferably, the bottom wall is covered with felt. More preferably, a lid is provided for covering the box with the dice stored therein when not in use.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
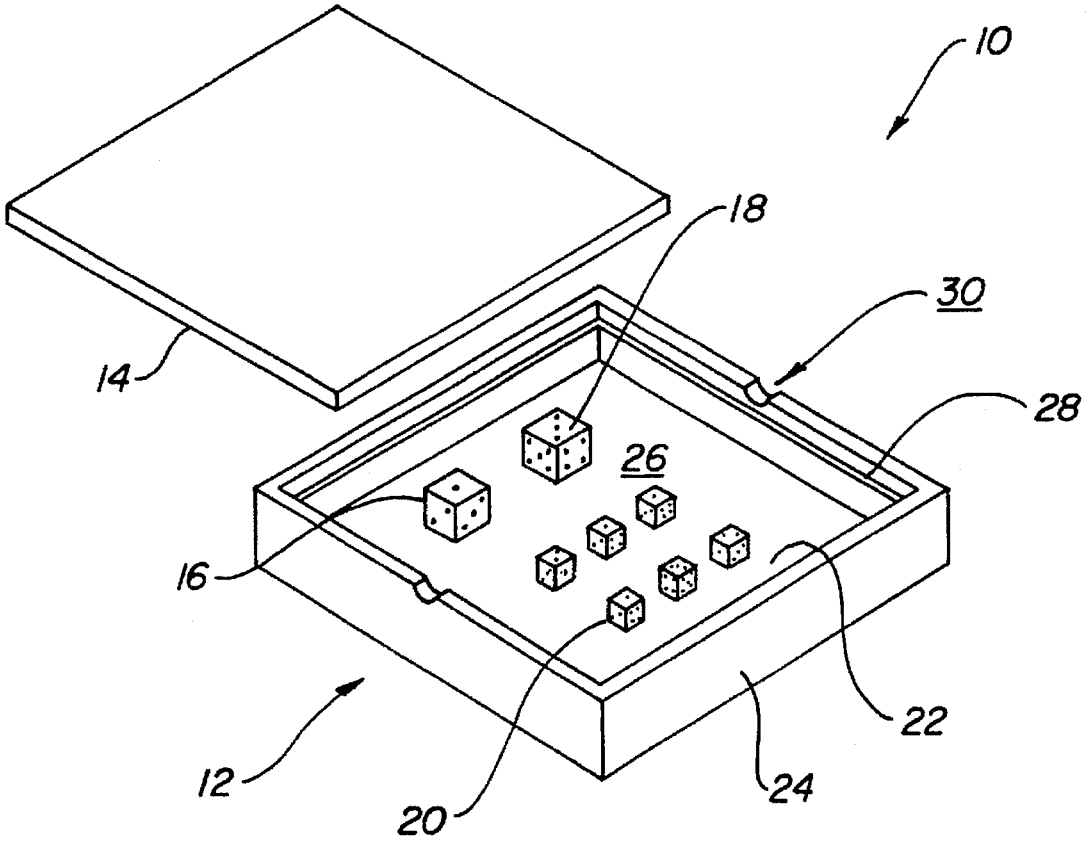
FIG. 1 is an isometric view of an exemplary embodiment of the dice game of the present invention.
Figure 2:
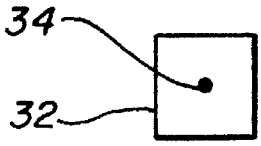
FIG. 2 is a view of a first side of the playing dice and the position die.
Figure 3:
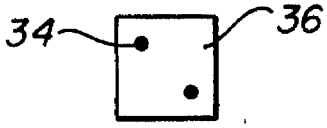
FIG. 3 is a view of a second side of the playing dice and the position die.
Figure 4:
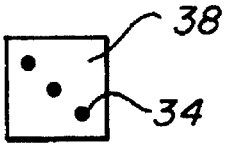
FIG. 4 is a view of a third side of the playing dice and the position die.
Figure 5:
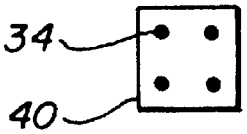
FIG. 5 is a view of a forth side of the playing dice and the position die.
Figure 6:
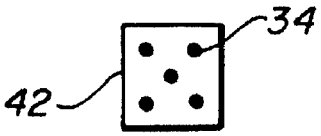
FIG. 6 is a view of a fifth side of the playing dice and the position die.
Figure 7:
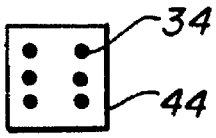
FIG. 7 is a view of a sixth side of the playing dice and the position die.

FIG. 1 is an isometric view of an exemplary embodiment of the dice game of the present invention generally designated by the numeral 10. Dice game 10 includes a game box 12, a lid 14, a position die 16, a bonus die 18 and six playing dice 20.

Game box 12 is square measuring thirteen and one-half inches along its sides. Box 12 has a bottom wall 22 surfaced with felt and four side walls 24 extending upwardly about its periphery to define a playing space 26. Playing space 26 is adapted to receive dice thrown therein. It is not required that the game box 12 be utilized. Any substantially level and hard surface will suffice.

A lip 28 is formed along the four side walls 24 for removably seating lid 14 thereon covering game box 12. A pair of holes 30 are formed through opposing side walls 24 above lip 28 for removing lid 14 from box 12.

Position die 16 and playing dice 20 are plastic six sided cubes. Position die 16 and playing dice 20 are identical in marking and only vary in position die 16 being larger. A preferred embodiment of position die 16 and playing dice 20 are shown in FIGS. 1 through 7. Position die 16 and playing dice 20 have a first side 32 (FIG. 2) upon which one spot 34 is applied representing one, a second side 36 (FIG. 3) having two spots 34 applied thereon representing two, a third side 38 (FIG. 4) upon which three spots 34 are applied representing three, a forth side 40 (FIG. 5) upon which four spots 34 are applied representing four, a fifth side 42 (FIG. 6) upon which five spots 34 are applied representing five and a sixth side 44 (FIG. 7) upon which six spots 34 are applied representing six.

Figure 8:
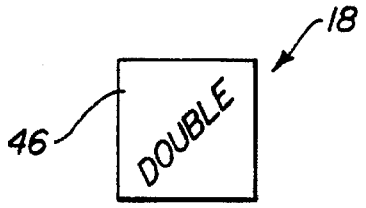
FIG. 8 is a view of a face of the bonus die having "DOUBLE" marked thereon.
Figure 9:
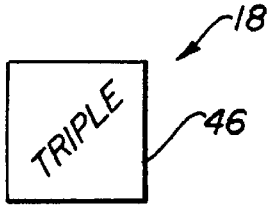
FIG. 9 is a view of a face of the bonus die having "TRIPLE" marked thereon.

As shown in FIG. 1, bonus die 18 is a plastic cube larger in size than playing dice 20. Bonus die 18 has three faces 46 having "DOUBLE" marked thereon as shown in FIG. 8. The remaining three faces 46 of bonus die 18 have "TRIPLE" marked thereon as shown in FIG. 9.

The rules of dice game 10 will now be described with reference to FIGS. 1 through 12. An initial order of play is first established where players are designated by having each player, in turn, throw position die 16. The player with the highest throw goes first with subsequent players being determined from highest roll to lowest roll.

At the beginning of each player's turn, play is initiated by throwing playing dice 20. Points are accumulated based upon the throw of dice 20. Each player in turn throws dice 20 in an attempt to first achieve a score of 10,000 points winning the game.

Scoring is valued by combinations of sides 32, 36, 38, 40, 42, 44 of dice 20 facing upward after being thrown. Dice 20 showing a first side 32 having a single spot 34 accumulate 100 points. Dice 20 showing a fifth side 42 having five spots 34 accumulate 50 points. No other sides 36, 38, 40, 44 accumulate points individually. Throws of three of a kind or triplets accumulate points based on the combination shown. Three 1's accumulate 1,000 points, three 2's accumulate 200 points, three 3's accumulate 300 points, three 4's accumulate 400 points, three 5's accumulate 500 points and three 6's accumulate 600 points. Throws containing three pairs accumulate 850 points. A throw showing a straight accumulates 1500 points. Throws of six of a kind automatically wins the game. These scores are tabulated below:

| THROW | POINT VALUE |
|---|---|
| one 1 | 100 |
| one 5 | 50 |
| three 1's | 1000 |
| three 2's | 200 |
| three 3's | 300 |
| three 4's | 400 |
| three 5's | 500 |
| three 6's | 600 |
| three pairs | 850 |
| straight | 1500 |
| six of a kind | WIN |

Once a player accumulates a score of 650 points, the player has the option to "dare" at the end of his turn thereby doubling or tripling the score thrown and having that score added to or deducted from the points previously accumulated. To dare the player rolls position die 16, if a value of 1 (first side 32) or 5 (fifth side 42) is thrown the player adds a doubled or tripled thrown value to his accumulated points. If a value other than one or five represented by sides 36, 38, 40, 44 is thrown then the player deducts a doubled or tripled thrown value to his accumulated points. To determine whether the thrown value is to be double or tripled the player rolls bonus die 18 and follows the instruction marked thereon.

Figure 10:
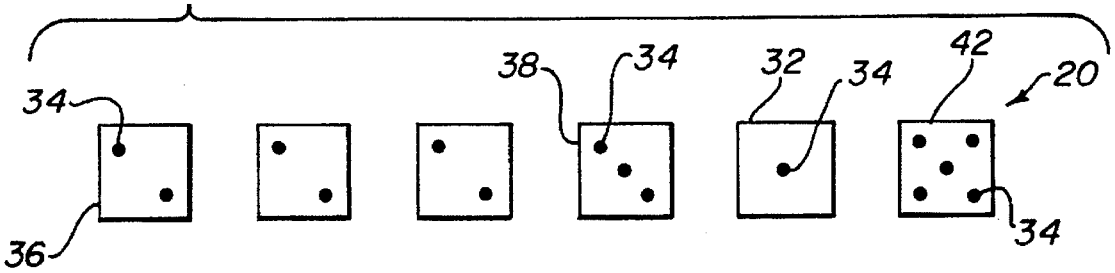
FIG. 10 is a top view of the upwardly facing or displayed sides of the playing dice following a roll or threw of such dice, as an example for describing the method of playing the dice game and calculating point score of such throw.

An example of a roll or throw of playing dice 20 may result in the displayed sides shown in FIG. 10, i.e., three second sides 36 each displaying two spots 34, one third side 38 displaying three spots 34, one first side 32 displaying one spot 34, and one fifth side 42 displaying five spots 34. Such a throw results in one three of a kind of two spots, for a calculated score of 200 points. The single third side 38 has no point value. The single first side 32 results in a point value of 100 points. The single fifth side 42 having five spots 34 displayed thereon provides 50 points. Accordingly, upon adding the various point values the total point score accumulated for that throw is 200+0+100+50=350 points.

Figure 11:
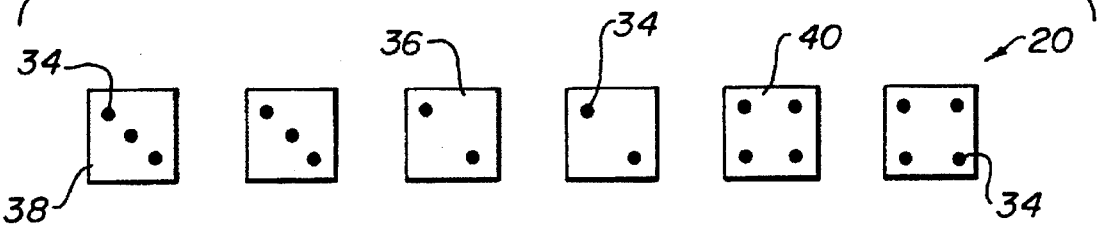
FIG. 11 is a top view of the upwardly facing or displayed sides of the playing dice following a roll or throw of such dice, as another example for describing the method of playing the dice game and calculating point score of such throw.

A second example of a throw of playing dice 20 is shown in FIG. 11. The displayed sides comprise a pair of third sides 38 having three spots 34, a pair of second sides 36 having two spots 34, and a pair of fourth sides 40 having four spots 34. This throw represents three pairs and accumulates 850 points.

Figure 12:
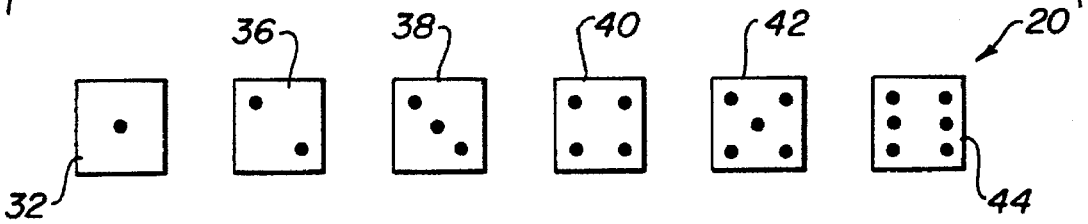
FIG. 12 is a top view of the upwardly facing or displayed sides of the playing dice following a roll or throw of such dice, as another example for describing the method of playing the dice game and calculating point score of such throw.

FIG. 12 is a third example of a throw of playing dice 20. The displayed sides comprise a first side 32, a second side 36, a third side 38, a forth side 40, a fifth side 42, and a sixth side 44. This throw represents a straight and accumulates 1500 points.

In the examples shown in FIGS. 10 through 12 the player may "dare" if he has accumulated 650 points previous to the throw shown in the figures. If the player chooses to "dare" the points scored in the throw will be double or tripled based on the roll of bonus die 18. The increased point value of the throw will be added to the players accumulated points if upon rolling position die 16 the displayed side shows one or five spots 34, if the position die 16 displays two, three, four or six spots 34 the increased point value will be deducted from the players accumulated points.

It can be seen from the preceding description that a method and device for dice games which has six playing dice for throwing and receiving points based on various combinations of indicia displayed by the upwardly facing sides or faces of the resting dice, has a bonus die having "DOUBLE" marked on three sides and having "TRIPLE" marked on three sides for rolling after a predetermined number of points have been accumulated for doubling or tripling the player's thrown score, the increased score to be added to or deducted from the player's accumulated score based on a roll of a die having spots on each side indicating a numerical of 1, 2, 3, 4, 5 and 6 respectively, has a position die each side thereof commonly having thereon different quantities of spots respectively representing the numbers 1, 2, 3, 4, 5 and 6, for throwing by each player at the beginning of the game for determining the order of play from the highest number thrown to the lowest, and has a box for storing the dice in and providing a playing space has been provided.

It is noted that the embodiment of the dice game described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A method of playing a dice game comprising the steps of:

providing six playing dice, each said die of which having six sides including a first side having thereon one spot representing a one, a second side having thereon two spots representing a two, a third side having thereon three spots representing a three, a forth side having thereon four spots representing a four, a fifth side having thereon five spots representing a five, and a sixth side having thereon six spots representing a six;

providing a bonus die having six faces, three said faces having "DOUBLE" marked thereon and three said faces having "TRIPLE" marked thereon;

establishing an initial order of play where players are designated as a first player, second player, and so on to a last player;

initiating a round of play by a first player throwing said playing dice for displaying a side of each die;

determining a players score for the throw wherein each said die showing a one scores 100 points;

wherein each said die showing a five scores 50 points;

wherein a throw of three of a kind resulting in three 1's accumulates 1,000 points, three 2's accumulates 200 points, three 3's accumulates 300 points, three 4's accumulates 400 points, three 5's accumulates 500 points and three 6's accumulate 600 points; wherein throws containing three pairs accumulate 850 points;

wherein throws showing a straight accumulates 1500 points;

wherein throws of six of a kind automatically wins the game; and allowing an option whereupon reaching a score of 650 points said player may choose to "dare," comprising the steps of, said player throwing said bonus die and doubling or tripling the thrown score as indicated by said displayed face of said bonus die, and said player throws a said playing die, whereupon throwing a one or a five said player adds the increased thrown score to the accumulated score and whereupon throwing a two, three, four or six said player deducts the increased thrown score from the accumulated score;

each said second player and so on to last player in turn throwing said playing dice in an attempt to achieve a score of 10,000 points to be declared a winner;

determining a players score for the throw and continuing additional rounds of play where a player's score accumulates as it is determined for each player.

2. The method according to claim 1, further including the steps of;

providing a position die having six sides including a first side having thereon one spot representing a one, a second side having thereon two spots representing a two, a third side having thereon three spots representing a three, a forth side having thereon four spots representing a four, a fifth side having thereon five spots representing a five, and a sixth side having thereon six spots representing a six.

3. The method according to claim 2, wherein:

during said establishing step, each said player throws said position die, said order being established from highest throw to lowest throw.

4. The method according to claim 3, wherein:

said position die is larger than said playing dice.

5. The method according to claim 2, wherein:

said position die is larger than said playing dice.

6. The method according to claim 1, further including the step of:

providing a game box having a bottom wall and four side walls extending upwardly about its periphery to define a playing space for throwing said dice therein.

7. The method according to claim 6, wherein:

said bottom wall of said game box is surfaced with felt.

8. The method according to claim 7, further including the step of:

providing a lid for covering said game box.

9. The method according to claim 6, further including the step of:

providing a lid for covering said game box.

10. A method of playing a dice game comprising the steps of:

providing a position die having six sides including a first side having thereon one spot representing a one, a second side having thereon two spots representing a two, a third side having thereon three spots representing a three, a forth side having thereon four spots representing a four, a fifth side having thereon five spots representing a five, and a sixth side having thereon six spots representing a six;

providing six playing dice, each said die of which having six sides including a first side having thereon one spot representing a one, a second side having thereon two spots representing a two, a third side having thereon three spots representing a three, a forth side having thereon four spots representing a four, a fifth side having thereon five spots representing a five, and a sixth side having thereon six spots representing a six;

providing a bonus die having six faces, three said faces having "DOUBLE" marked thereon and three said faces having "TRIPLE" marked thereon;

establishing an initial order of play by each player throwing said position die, whereby said players are designated as a first player, second player, and so on to a last player by highest throw to lowest throw of said position die;

initiating a round of play by a first player throwing said playing dice for displaying a side of each die;

determining a player's score for the throw:

wherein each said die showing a one scores 100 points;

wherein each said die showing a five scores 50 points;

wherein a throw of three of a kind resulting in three 1's accumulates 1,000 points, three 2's accumulates 200 points, three 3's accumulates 300 points, three 4's accumulates 400 points, three 5's accumulates 500 points and three 6's accumulate 600 points; wherein throws containing three pairs accumulate 850 points;

wherein throws showing a straight accumulates 1500 points;

wherein throws of six of a kind automatically wins the game; and allowing an option whereupon reaching a score of 650 points said player may choose to "dare," comprising the steps of, said player throwing said bonus die and doubling or tripling the thrown score as indicated by said displayed face of said bonus die, and said player throws a said playing die, whereupon throwing a one or a five said player adds the increased thrown score to the accumulated score and whereupon throwing a two, three, four or six said player deducts the increased thrown score from the accumulated score, each said second player and so on to last player in turn throwing said playing dice in an attempt to achieve a score of 10,000 points to be declared a winner;

determining a players score for the throw and continuing additional rounds of play where a player's score accumulates as it is determined for each player.

11. The method according to claim 10, wherein:

said position die is larger than said playing dice.

12. The method according to claim 10, further including the step of:

providing a game box having a bottom wall and four side walls extending upwardly about its periphery to define a playing space for throwing said dice therein.

13. The method according to claim 12, wherein:

said bottom wall of said game box is surfaced with felt.

14. The method according to claim 13, further including the step of:

providing a lid for covering said game box.

15. The method according to claim 14, wherein:

said position die is larger than said playing dice.

16. The method according to claim 13, wherein:

said position die is larger than said playing dice.

17. The method according to claim 12, further including the step of:

providing a lid for covering said game box.

18. The method according to claim 14, wherein:

said position die is larger than said playing dice.

19. The method according to claim 12, wherein:

said position die is larger than said playing dice.

20. A method of playing a dice game comprising the steps of:

providing a position die having six sides including a first side having thereon one spot representing a one, a second side having thereon two spots representing a two, a third side having thereon three spots representing a three, a forth side having thereon four spots representing a four, a fifth side having thereon five spots representing a five, and a sixth side having thereon six spots representing a six;

providing six playing dice, each said die of which having six sides including a first side having thereon one spot representing a one, a second side having thereon two spots representing a two, a third side having thereon three spots representing a three, a forth side having thereon four spots representing a four, a fifth side having thereon five spots representing a five, and a sixth side having thereon six spots representing a six;

providing a bonus die having six faces, three said faces having "DOUBLE" marked thereon and three said faces having "TRIPLE" marked thereon;

providing a game box having a bottom wall surfaced with felt and four side walls extending upwardly about its periphery to define a playing space for throwing said dice therein;

providing a lid for covering said game box;

establishing an initial order of play by each player throwing said position die, whereby said players are designated as a first player, second player, and so on to a last player by highest throw to lowest throw of said position die;

initiating play by throwing said playing dice for displaying a side of each die, wherein each said player in turn throws said playing dice in an attempt to achieve a score of 10,000 points to be declared a winner;

wherein each said die showing a one scores 100 points;

wherein each said die showing a five scores 50 points;

wherein a throw of three of a kind resulting in three 1's accumulates 1,000 points, three 2's accumulates 200 points, three 3's accumulates 300 points, three 4's accumulates 400 points, three 5's accumulates 500 points and three 6's accumulate 600 points; wherein throws containing three pairs accumulate 850 points;

wherein throws showing a straight accumulates 1500 points;

wherein throws of six of a kind automatically wins the game; and whereupon reaching a score of 650 points said player may choose to "dare," whereby, said player throws said bonus die and doubles or triples the thrown score as indicated by said displayed face of said bonus die, and said player throws a said die, whereupon throwing a one or a five said player adds the increased thrown score to the accumulated score and whereupon throwing a two, three, four or six said player deducts the increased thrown score from the accumulated score.

* * * * *